United States Patent [19]

Barrat

[11] 3,985,686

[45] Oct. 12, 1976

[54] DETERGENT COMPOSITIONS CONTAINING ENZYMES

[75] Inventor: Christian Barrat, Brussels, Belgium

[73] Assignee: The Procter & Gamble Company, Cincinnati, Ohio

[22] Filed: Nov. 30, 1972

[21] Appl. No.: 310,740

[30] Foreign Priority Application Data

Dec. 20, 1971 Luxembourg ..... 64487/71

[52] U.S. Cl. ..... 252/547; 195/66 R, 252/528, 252/DIG. 12

[51] Int. Cl. ..... C11d 3/26; C11d 1/38

[58] Field of Search ..... 252/DIG. 12, 547, 528

[56] References Cited

UNITED STATES PATENTS

| | | | |
|---|---|---|---|
| 3,345,300 | 10/1967 | Speel | 252/547 |
| 3,623,956 | 11/1971 | Kalaboklas | 195/66 R |
| 3,623,957 | 11/1971 | Feldman | 195/66 R |
| 3,689,424 | 9/1972 | Berg et al. | 252/110 |
| 3,704,228 | 11/1972 | Eckert et al. | 252/DIG. 12 |
| 3,748,233 | 7/1973 | Viccaro | 195/66 R |

FOREIGN PATENTS OR APPLICATIONS

| | | |
|---|---|---|
| 7,209,755 | 1/1973 | Netherlands |
| 2,009,722 | 9/1971 | Germany |

*Primary Examiner*—Dennis E. Talbert, Jr.
*Assistant Examiner*—Edith R. Buffalow
*Attorney, Agent, or Firm*—Edmund F. Gebhardt & Forrest L. Collins

[57] ABSTRACT

This invention relates to enzymatic detergent compositions containing a combination of anionic and cationic surface-active agents. In more detail, these compositions contain as essential ingredients enzymes, preferably proteases, in combination with an essentially binary active system comprising a cationic surface-active agent and an anionic surface-active agent whereby these detergent ingredients are to used in well-defined ratios. The performance advantages derivable from the use of these compositions principally reside in the improved cleaning, especially stain removal, performance. Additionally, some textile softening can be obtained from the compositions claimed as well. Obviously, the occurrennce of that latter advantage depends upon the nature of the cationic-active ingredients used and upon the ratio of cationic to anionic surface-active agents. Or, in other words, the softening performance is not a requisite for the compositions of this invention taken in its broadest sense, but an additional advantage upon which value is set for today's textile washing habits.

4 Claims, No Drawings

DETERGENT COMPOSITIONS CONTAINING ENZYMES

BACKGROUND OF THE INVENTION

The simultaneous use of anionic and cationic surface-active agents in detergent compositions, has been known to be attractive, for a good time already, assuming the performance advantages, derivable from compositions containing the individual ingredients, would sum up for compositions containing both. But the interference — inhibition — from anionic and the cationic surface-active agents has been known ever since to constitute a major obstacle to the realization of these plans. The reason for this inhibition — reciprocal deactivation — of the anionic and cationic detergents apparently resides in the formation of, in the laundry medium, insoluble precipitants which eventually may adhere to the fibers. This disadvantage is particularly well-known with respect to the obtention of a combined softening and cleaning performance in a single laundering operation instead of using the textile-softening compositions, particularly on basis of cationic ingredients, during the last rinse cycle of the washing operation. The disclosures of U.S. Pat. No. 3,560,390 confirm that incompatibility of anionic surface-active agents both being dissolved in an aqueous laundry solution containing major amounts of anionic ingredients. Obviously, much effort has been spent to cope with these shortcomings, i.e., to formulate detergent compositions wherein the cationic and anionic surface-active agents simultaneously exert their specific activity. So for example, the teachings of German Pat. (DAS) No. 1,419,362 recommend to circumvent the relative deactivation resulting from the combination of cationic and anionic surfactants in detergent compositions through the addition of a condensation product of tertiary fatty amines with from 8 to 18 carbon atoms and ethylene oxide, and/or a quaternary or di-quaternary ammonium salt of a condensation product of tertiary fatty amines and ethylene oxide whereby a well-defined weight ratio shall be observed. These teachings pertain to the stabilization of softening actives during a "classic" softening operation, i.e., during the last rinse cycle of the washing operation. All the more they will lead away the man skilled in the art from formulating a composition containing major amounts of both oppositely charged ingredients. The disclosures of U.S. Pat. No. 3,325,404 constitute an additional example of the prior art knowledge. Compositions for simultaneously laundering and softening fabrics are disclosed whereby di-long-alkyl di-short-alkyl ammonium salts are combined with a selected quaternary ammonium compound containing only one alkyl radical having from 8 to 20 carbon atoms in the alkyl chain. These compositions have slightly less tendency to precipitate. Still another approach for combining these different kinds of surface-active agents is suggested by the disclosures of U.S. Pat. No. 3,351,483. In that case, major amounts of urea are used for stabilizing the quaternary softening ingredients whereby these latters are bound to the urea additive in form of inclusion-compounds. The teachings of Belgian Pat. No. 745,814 also belong to the state of the art inasmuch as detergent compositions are disclosed containing anionic surface-active agents in combination with softening agents which are represented by the condensation products of fatty acids and amines. Certain specific quaternary ammonium compounds can be added as optional ingredients as well. It is mentioned that these teachings are unexpected because the combination of quaternary softening compounds and anionic surface-active agents leads to undesirable precipitation which makes the composition not suitable for use in washing operations. It is furthermore mentioned that the composition described in this prior art reference may contain the usual amounts of commercially available proteases, amylases, lipases or mixtures thereof.

The use of enzymes, particularly proteases, in detergent compositions containing non-cationic surface-active agents is known for a long time already. These compositions containing anionic and/or nonionic detergent actives and builders have earned in recent years a wide commercial acceptability and accordingly are very well appreciated by housewives. However, as is well known many enzymes including those which are suitable for being used within the compositions of this invention cannot be used in combination with cationic quaternary ammonium salts such as cetyl-trimethyl-ammonium chloride and di-stearyl-dimethyl ammonium chloride, simply because they are practically ineffective in regard to stain removal performance. The same applies, although to a slightly lesser extent, to a combination of the essential enzyme ingredients of this invention and anionic surface-active agents.

We have now found that unexpected and unforeseeable performance advantages can be attained through the use of detergent compositions containing as essential ingredients a combination of cationic and anionic surface-active agents and certain enzymes. In more detail, the detergent compositions of this invention do not possess the performance deficiencies flowing from the binary combinations of the essential ingredients we use and also result in an improved cleaning and particularly stain removal performance. These compositions containing surface-active agents and cationic ingredients, if desired in combination with other usual detergent composition additives consist essentially of:

a. an enzyme, which, when used in a 1% solution of the finished composition of this invention wherein the total anionic and cationic actives have been substituted by nonionic surfactants, gives a better cleaning performance, than when used under the same conditions, in an identical formula except for the cationic actives which have been replaced by anionic surfactants;
b. from about 10 to about 90% by weight of a cationic surface-active agent; and
c. from about 90 to about 10% by weight of an anionic surface-active agent, the relative quantities of (b) and (c) being expressed by reference to the sum of both.

The enzymes which can advantageously be used within the composition of this invention can be selected by performance testing thereby using the method described in Example I. The acceptability criteria are based on a comparative cleaning performance assessment of compositions containing a candidate enzyme. In more detail, a particular enzyme species qualifies in regard to the requirements of this invention, when the performance obtained from a 1% aqueous solution of the composition of this invention (containing that candidate enzyme in an amount as claimed), wherein the anionic and cationic surfactants have been substituted by the same amount in weight of nonionic surfactants, is better, by reference to the performance obtained with the same conditions, except that the cationic actives have been replaced by the same amount by weight of anionic actives. The cleaning performance can be termed "better" in the event the sum of the reflectances of the four differently stained swatches obtained from the composition containing the nonionic detergents is significantly better than the corresponding stain removal results obtained from the same detergent composition, except for the surfactants which consist of anionic detergents.

An alternative possibility for defining the enzymes suitable for being used within a well-defined composition according to this invention relies on the determination of the iso-electric point of that particular enzyme. That characteristic shall at least be slightly greater and preferably greater than the pH of a 1% aqueous solution of a particular detergent composition according to this invention to qualify the enzyme fulfills, when incorporated into that particular composition, the inventive advantages. Or, in other words, a certain enzyme will procure, when incorporated in a well-defined detergent composition giving a certain pH in a 1% aqueous solution, the advantages claimed, whereas when used in another composition, a 1% aqueous solution of which has for example a pH which is greater than the iso-electric point, then that enzyme species does not fit within that composition of this invention. This method is particularly suitable for the selection of the proteolytic enzyme which can be incorporated into these compositions, although other enzyme species such as amylases and lipases can be selected as well.

The iso-electric point for a particular enzyme shall be about 0.5 greater than the pH of the detergent solution containing that enzyme. No precise understanding of the underlying reasons has been offered as of yet, although, the performance of the enzyme decreases in case the iso-electric point becomes substantially identical or smaller than the pH of the solution. The iso-electric point can be determined by electrophoresis on agarose thereby using the technique described by R. J. Wieme, in *Agar Gel Electrophoresis*, Elsevier Publ. Comp. 1965.

"Greater," with respect to the numerical value of the iso-electric point by reference to the pH, means that the absolute value of the iso-electric point exceeds the value of the pH. For example, if a 1% solution of the detergent composition has a pH of 9.0, then the iso-electric point of the enzyme shall be greater than 9.0, e.g. 9.5.

Although many different enzyme species may fit the compositions of this invention as described hereinbefore, especially preferred with a view to the actual commercial interest, are those enzymes which are suitable for being used in the detergent compositions of this invention having a pH in a 1% aqueous solution of about 9.0 and above, preferably from about 9.5 to about 11. The iso-electric point of the proteolytic enzymes which are used for the preferred compositions of this invention shall accordingly be greater than about 9.5 and preferably greater than about 10. The commercially available proteolytic enzyme preparations derived from bacillus subtilis such as for example ALCALASE — manufactured by Novo Industri A.S., Copenhagen, Denmark — and MAXATASE — manufactured by Gist-Brocades N.V., Delft, The Netherlands — do not procure the inventive advantages when incorporated into these preferred compositions of this invention. Some of the active ingredients of these enzyme preparations apparently belong to category EC (Enzyme Commission) 3.4.4.16 with the recommended trivial name subtilopeptidase A.

Examples of the preferred proteases are those produced by the bacterium strains referred to in the specification of Belgian Pat. No. 721,730, Table IX, type 1, and which have been deposited under NCIB numbers and also those enzymes derived from strains of bacillus alcalophilus. Particularly preferred are the proteases produced by strains deposited under NCIB numbers 10147, 10313, 10315, 10317 and 8772.

The enzymes shall be used in an amount from 0.001 to about 5% by weight calculated on the finished detergent composition. The preferred ranges vary according to the kind of enzymes used. So, for example, in the event proteases are used they should preferably be incorporated in an amount from about 0.1 to about 2% by weight of the finished detergent composition. The preferred usage range for amylase is from about 0.05 to about 1% by weight of the finished detergent composition.

All anionic detergents which are known as being suitable for being used in detergent compositions can be used within the compositions as set forth herein. Preferred for use are the anionic synthetic water-soluble salts of organic sulfuric reaction products having in their molecular structure an alkyl radical containing from about 8 to about 22 carbon atoms and a radical selected from the group consisting of sulfonic acid and sulfuric acid ester radicals. Examples of these preferred anionics are the sodium and potassium salts of the reaction products obtained by sulfating $C_8$–$C_{18}$ fatty alcohols derived from tallow and coconut oil. Other preferred anionic surfactants include the water-soluble alkyl benzenesulfonates wherein the alkyl group contains from about 9 to about 15 carbon atoms; sodium alkyl glyceryl ether sulfonates, especially those ethers of the higher alcohols derived from tallow and coconut oil; sodium coconut oil fatty acid monoglyceride sulfates and sulfonates; water-soluble salts of the sulfation products of 1 mole of a higher fatty alcohol, such as tallow or coconut oil alcohols, with about 1 to 6 moles of ethylene oxide; water-soluble salts of alkyl-phenol and ethylene oxide ether sulfates containing up to about 10 ethylene oxide molecules and wherein the alkyl radical contains from 8 to 12 carbon atoms. Other preferred anionic detergents for use in these compositions include the sulfonated olefins as described in, e.g. U.S. Pat. No. 3,332,880.

All surface-active agents, which, when used in a 1% solution of the composition of this invention are present as cationic radicals meet with the requirements for being used within the compositions claimed. Well-known representatives of this class of ingredients are the quaternary ammonium compounds having two hydrophobic groups with from 8 to 20, preferably from 12 to 20 carbon atoms per radical. Specific examples thereof are: di-octadecyl-dimethyl-ammonium chloride; the ester formed from two moles of stearic acid and one mole of tri-ethanol-methyl-ammonium chloride; the quaternary derivative of methyl chloride with 1-heptadecyl-2-(β-heptadecylcarbonamido)-ethylimidazoline the reaction product of hexadecyl-dimethyl amine and dodecylglycid ether quaternized with dimethyl sulfate; and other products which have been quaternized with methyl chloride such as, for example, the amides prepared from 2 moles of palmitic acid and one mole of di-ethylene tetramine. Other well-known examples of cationic surfactants are represented by the quaternary type germicides such as the mono-long-alkyl tri-short-alkyl ammonium salts; and $C_{8-18}$ alkyl dimethyl 3,4-dichlorobenzylammoniumchloride. The preferred cationic ingredient suitable for use within the compositions of this invention are, for commercial reasons, those when contribute to the cleaning performance thereby providing also some softening and/or antibacterial activity. Well-known examples of these preferred cationic ingredients are the quaternization products of suitable tertiary N-bases such as morpholin, pyridin dimethylaminopropylamine, methyl diethanol amine, di-ethyl ethanolamine, triethanolamine and the like. Besides these lower molecular weight quaternary products, the water-soluble higher molecular onium compounds such as quaternary ammonium, pyridinium and isochinolinium compounds can as well be used. The most preferred cationic ingredients for use in the compositions of this invention are the di-long-alkyl di-short-alkyl ammonium salts especially distearyl dimethyl ammonium chloride.

The essential constituents of the active system, i.e., the cationic and anionic surface-active agents, shall be present in a weight ratio from about 10 to about 90 to from about 90 to about 10. The preferred ratios of cationic to anionic surface-active agents are from about 20 to about 80 to about 80 to about 20. Obviously, some optimization work has to be carried out to formulate a particular composition taking into consideration the kind of enzyme and the kind of cationic and anionic ingredients used. The total amount of surface-active agents, i.e., the sum of cationic and anionic ingredients shall be within the range from 2 to 50%, preferably from 5 to 30% by weight calculated on the finished detergent composition. Obviously, the level of surface-active agents in a particular composition depends upon its intended usage, its physical state, as well as on the qualitative and quantitative characteristics of other major and minor ingredients which can be added.

The compositions of this invention can besides the essential ingredients referred to hereinbefore, optionally contain additional surface-active agents such as nonionic, semi-polar, ampholytic and zwitterionic detergents. Obviously, the choice of these additional detergents is mostly made in accordance with the intended use of the final detergent compositions. Also the level in which these additional surfactants are used depends on various factors, the determination of which may request a certain amount of routine testing.

The monionic synthetic detergents which can be used are characterized by the presence of an organic hydrophilic and an organic hydrophobic group. The hydrophilic character of these compounds is mostly based on the presence of alkylene oxide chains, amine oxide, sulfoxide and phosphine oxide radicals. The preferred hydrophobic groups include aliphatic alcohols having from 8 to 22 carbon atoms and fatty acid amides.

Examples of semipolar detergents include the amine oxides, phosphine oxides and sulfoxides. Long chain tertiary amine oxides such as dimethyldodecylamine oxide and bis-(2-hydroxyethyl) dodecylamine are representatives of these classes. Suitable phosphine oxides are disclosed in U.S. Pat. No. 3,304,263, and include: dimethyldodecylphosphine oxide and dimethyl-(2-hydroxydodecyl) phosphine oxide. The suitable long chain sulfoxides correspond to the formula $$R_1 - \overset{\overset{\displaystyle O}{\|}}{S} - R_2$$

wherein $R_1$ and $R_2$ are substituted or unsubstituted alkyl radicals, the former containing from about 10 to about 28 carbon atoms, whereas $R_2$ contains from 1 to 3 carbon atoms. Specific examples of these sulfoxides are: dodecyl methyl sulfoxide and 3-hydroxy tridecyl methyl sulfoxide.

Ampholytic and zwitterionic synthetic detergents can as well be used. Examples of ampholytic synthetic detergents are: sodium 3-dodecylaminopropionate and sodium 3-dodecylaminopropane sulfonate. Useful zwitterionic synthetic detergents are 3-(N,N-dimethyl-N-hexadecylammonio) propane-1-sulfonate and 3-(N,N-dimethyl-N-hexadecylammonio)-2-hydroxy propane-1-sulfonate.

The detergent compositions of this invention can contain, in addition to the essential ingredients, also other usual constituents and additives for such compositions and which are well known to the man skilled in the art in this field of technology. Besides the ingredients already listed hereinbefore, one can consider adding organic and inorganic builders, peroxy-bleach compounds, activators for these peroxy-bleach ingredients, suds controlling agents including suds boosters, suds stabilizing agents and suds depressing agents, optical brighteners, dyes and perfumes, soil suspending agents, silicate solids, solubilizing agents, non-toxic non-volatile organic solvents and other detergent additives.

The detergent builders can be inorganic or organic in nature and can be selected from a wide variety of known builder materials. Useful alkaline inorganic builders are alkali metal carbonates, phosphates, polyphosphates, and silicates. Specific examples of such salts are sodium and potassium tripolyphosphates, carbonates, phosphates and hexametaphosphates. Useful alkaline organic builders are alkali metal, ammonium and substituted ammonium polyphosphonates, polyacetates and polycarboxylates.

The polycarboxylate builder salts useful herein consist of water-soluble salts of polymeric aliphatic polycarboxylic acids of the type described in U.S. Pat. No. 3,308,067. Examples include the polymers of itaconic acid, maleic acid, fumaric acid and mesaconic acid.

Peroxy bleach compounds can be incorporated in an amount of up to 30% by weight of the total detergent composition. All bleaching ingredients which are currently used in detergent compositions may fit within the compositions of this invention. Sodium perborate and sodium percarbonate are preferred because of their commercial availability. Also up to 20% by weight of the detergent composition of activators for peroxy bleach compounds may be added. They serve to take better profit of the oxybleach ingredient at lower temperature. As a rule, they form peracids with the active oxygen of the bleaching compounds; these peracids exert more efficiently and at lower temperature their bleaching activity. Well-known activators are maleic anhydride, phthalic anhydride, tetra-acetylmethylenediamine, tetra-acetylethylenediamine, triacetylisocyanurate and benzoylimidazole.

Suds controlling agents in an amount of up to 10% of the finished detergent compositions can be added as well. Their amount and nature depend frequently upon the intended usage of the particular detergent composition. As an example, detergent compositions which are to be used for automatic (machine) laundry operations shall contain suds depressors such as, for example, saturated fatty acids having 16 to 22 carbon atoms or siloxanes.

Relatively minor quantities of other detergent additives such as optical brighteners, dyes, perfumes, and so on are incorporated in levels which normally do not exceed 5% by weight of the total detergent composition.

It may also be useful to add stabilizing agents for the enzymatic activity during prolonged storage. Specific enzyme species call for specific stabilizing agents. As an example, partially hydrolyzed collagen having a molecular weight of about 10,000 constitutes a satisfactory stabilizing agent for proteases. The usual activators for the enzymatic acitivity can be added as well. Suitable examples for this class of additives are the activators containing sulphydryl groups as disclosed in French Pat. No. 2,023,628. Up to 10% of soil-suspending agents can also be used. Well-known examples of this class of ingredients are carboxymethylcellulose and polymeric ingredients such as those based on the polymerization product of vinyl derivatives and maleic anhydride. Silicate solids can be used up to the same level, i.e., about 10% by weight. Additional well-known detergent additives can be incorporated into detergent compositions according to the physical presentations of the compositions and also taking into consideration their intended use. Examples of this class of additives include lower alcohol solubilizers, such as methyl, ethyl, propyl and isopropyl alcohol, xylene, toluene, and benzene sulfonic acids, low-volatile non-toxic solvents, particularly aromatic solvents, humidity and so on.

A series of examples is given hereinafter to illustrate the invention and to facilitate its understanding.

EXAMPLE I

The detergent compositions having the formulation given hereinafter are prepared by mixing the ingredients before the experimental testing:

| Ingredients | Parts by weight |
|---|---|
| surface active agents | 10 and see below |
| sodiumtripolyphosphate | 35 |
| sodium perborate tetrahydrate | 30 |
| silicate solids; ratio $NaO/SiO_2 = 2.0$ | 5 |
| carboxymethylcellulose | 0.8 |
| sodium sulfate | 10 |
| proteolytic enzyme preparation | see below |
| minor ingredients and humidity | balance to 100 |

These detergent compositions are used at a concentration of 0.70% by weight in a hard water(20 U.S. grains/US gallon).

The test cotton swatches stained with any of the following staining solutions are used for evaluation purposes: milk-ink; blood-milk-ink; egg-ink; and water cress.

These swatches are either commercially available, e.g., from EMPA, St. Gallen, Switzerland — or can be prepared by immersing the swatches in the corresponding staining solution, passing them through a hand-wringer, drying them and denaturing them in hot water, if necessary.

The comparative testing procedure is as follows:

The stained swatches are washed in a "launderometer" supplied by Atlas Electric Devices Company, Chicago, Ill., thereby using a heat-up cycle from room temperature to 60°C in 40 minutes. After having reached that latter temperature, the operation is interrupted, the swatches are rinsed, passed through a hand-wringer and dried for 30 minutes at 50°C.

The stain removal resulting from the washing procedure, as described hereabove, is measured with an EEL reflectance spectrophotometer (Evans Electroselenium Ltd. U.K.) equipped with the adequate filter.

A reference (blank) operation is carried along with each series of tests. The blank consists of the detergent solution as used for the stain removal testing except that no enzymes have been added.

The stain removal results are represented by the sum of the reflectances of the four differently stained swatches whereby the individual reflectance for a single swatch is represented by the reflectance of the test swatch minus the reflectance of the reference swatch.

The proteolytic enzyme preparations are used in such an amount that the detergent solutions contain 12,000 DU (Delft Unit*)/liter of laundry solution.

(*)See also: Appendix 2 of trade brochure "MAXATASE" issued in April, 1967 by Royal Netherlands Fermentation Industries, Ltd.-Delft-Holland The stain removal results obtained with the solutions of various mixtures of cetyl trimethyl ammonium bromide (CTAB) and sodium linear dodecyl benzene sulfonate (LAS) in combination with proteolytic enzymes are as follows:

Stain Removal

| Surfactant system in parts by wt. CTAB | LAS | no enzyme | proteolytic enzyme produced by bacillus alcalophilus NCIB 8772 | proteolytic enzyme produced by bacterium strain NCIB 10147 | proteolytic enzyme derived from bacillus subtilis var. Carlsberg-(Alcalase) |
|---|---|---|---|---|---|
| — | 10 | 85 | 93 | 160 | 140 |
| 1 | 9 | 84 | 125 | 172 | 132 |
| 2 | 8 | 84 | 155 | 180 | 125 |
| 3 | 7 | 82 | 160 | 172 | 115 |
| 4 | 6 | 81 | 145 | 160 | 110 |
| 6 | 4 | 79 | 135 | 150 | 100 |
| 10 | — | 75 | 76 | 80 | 75 |

These data show how the enzymes produced by the bacterium strains NCIB 8772 and 10147 improve their cleaning performance in presence of a mixture of anionic and cationic surface-active agents whereas the proteolytic enzymes derived from bacillus subtilis var. Carlsberg do not procure in mixture with anionic and cationic surfactants these advantages or even decrease by reference to a full anionic formula. The pH of the laundry solution prepared as described in this example is 9.6 whereas the iso-electric point for the bacillus subtilis var. Carlsberg derived proteases is below 9.6. The proteases produced by bacterium strains NCIB 8772 and 10147 have an iso-electric point well above the pH of the solution. Confirmation of the testing results of this example can also be found through performance testing whereby the protease derived from bacillus subtilis var. Carlsberg shows optimum efficiency in a full anionic formulation whereas the proteases produced by NCIB 8772 and 10147 show maximum efficiency in nonionic formulation, i.e., in quantitively replacing LAS by a nonionic surface-active agent.

EXAMPLE II

The detergent composition of Example I has been used for comparative washing evaluations as described in Example I. The difference lies in the use of mixture of distearyl dimethyl ammonium chloride (DSAC) and sodium linear dodecyl benzene sulfonate (LAS) in presence of proteolytic enzymes.

The testing (stain removal) results are as follows:

STAIN REMOVAL

| Surfactant system in parts by wt. CTAB | LAS | no enzyme | proteolytic enzyme produced by bacillus alcalophilus NCIB 8772 | proteolytic enzyme produced by bacterium strain NCIB 10147 | proteolytic enzyme derived from bacillus subtilis var. Carlsberg-Alcalase) |
|---|---|---|---|---|---|
| — | 10 | 100 | 110 | 172 | 150 |
| 1 | 9 | 98 | 125 | 180 | 147 |
| 2 | 8 | 96 | 150 | 185 | 138 |
| 3 | 7 | 96 | 153 | 182 | 130 |
| 4 | 6 | 95 | 155 | 176 | 121 |
| 6 | 4 | 90 | 150 | 165 | 105 |
| 10 | — | 88 | 90 | 95 | 89 |

The results obtained with mixtures of LAS and dialkyl dimethyl ammonium salt are in line with those obtained with mixtures of LAS on a monoalkyl trimethyl ammonium salt and confirm the performance advantages derivable from the use of the compositions of this invention.

What is claimed is:

1. A detergent composition consisting essentially of:

(a) from 0.001% to about 5% by weight of a proteolytic enzyme having an iso-electric point greater than 9.5 selected from the group consisting of the enzymes produced by bacillus alcalophilus NCIB8772 and bacterium strain NCIB 10147;

(b) from about 20% to about 80% by weight of a cationic surfactant *selected from the group consisting of monoammonium di-long-alkyl di-short alkyl and mono-long-alkyl tri-short-alkyl salts and mixtures thereof*; and (c) from about 80% to about 20% by weight of an anionic surfactant;

wherein said surfactants (b) and (c) are expressed by reference to the sum of both.

2. A detergent composition in accordance with claim 1 wherein said proteolytic enzyme is present in an amount from 0.1 to 2% by weight.

3. A detergent composition in accordance with claim 1 wherein said anionic surfactant is a water soluble alkyl benzene sulfonate having from about 9 to about 15 carbon atoms in the alkyl group.

4. A detergent composition in accordance with claim 3 wherein said cationic surfactant is represented by distearyl dimethyl ammonium chloride.

* * * * *